US005873491A

United States Patent [19]

Garcia et al.

[11] Patent Number: 5,873,491

[45] Date of Patent: Feb. 23, 1999

[54] SET OF COMPONENTS FOR ASSEMBLY AS A DISPENSING PACKAGE OF THE NON-VENTED TYPE HAVING AN INTERNAL, COLLAPSIBLE BAG

[75] Inventors: Firmin Garcia, Evreux; Laurent Decottignies, Le Sacq, both of France

[73] Assignee: Valois S.A., Verneuil-Sur-Avre Cedex, France

[21] Appl. No.: 843,165

[22] Filed: Apr. 14, 1997

[51] Int. Cl.[6] ..... B65D 35/28

[52] U.S. Cl. ..... 222/95; 222/321.7

[58] Field of Search ..... 222/95, 153.09, 222/183, 321.7, 321.9

[56] References Cited

U.S. PATENT DOCUMENTS

| | | |
|---|---|---|
| 5,004,123 | 4/1991 | Stoody . |
| 5,271,534 | 12/1993 | Fillmore et al. . |

FOREIGN PATENT DOCUMENTS

| | | |
|---|---|---|
| 354 137 A1 | 2/1990 | European Pat. Off. . |
| 381 627 A1 | 8/1990 | European Pat. Off. . |
| 410 857 A1 | 1/1991 | European Pat. Off. . |
| 486 355 A1 | 5/1992 | European Pat. Off. . |
| 499 766 A1 | 8/1992 | European Pat. Off. . |
| 505 611 A2 | 9/1992 | European Pat. Off. . |
| 521 278 A1 | 1/1993 | European Pat. Off. . |
| 548 840 A2 | 6/1993 | European Pat. Off. . |
| 585 908 A2 | 3/1994 | European Pat. Off. . |
| 696 479 A1 | 2/1996 | European Pat. Off. . |
| 2 668 756 | 5/1992 | France . |
| 2 669 306 | 5/1992 | France . |
| 2 685 285 | 6/1993 | France . |
| 2 710 036 | 3/1995 | France . |
| 2 718 372 | 10/1995 | France . |
| 2 059 383 A | 4/1981 | United Kingdom . |
| WO 93/22220 | 11/1993 | WIPO . |
| WO 93/24392 | 12/1993 | WIPO . |

OTHER PUBLICATIONS

"Valois Perfumery" brochure dated Aug. 1996.

"Valois Cosmetics" brochure dated Mar. 1993.

*Primary Examiner*—Gregory L. Huson

*Attorney, Agent, or Firm*—Rockey, Milnamow & Katz, Ltd.

[57] ABSTRACT

A set of components is provided for assembly as a dispensing package for a fluid product. A collapsible bag is provided for holding the fluid product. The collapsible bag is attached to a support which in turn is mounted within a hollow body. A retention member holds a finger-operable pump to the support for communication with the interior of the bag.

11 Claims, 4 Drawing Sheets

SET OF COMPONENTS FOR ASSEMBLY AS A DISPENSING PACKAGE OF THE NON-VENTED TYPE HAVING AN INTERNAL, COLLAPSIBLE BAG

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to a dispensing package for containing and dispensing a fluid product. More particularly, the invention relates to an improved set of components which can be assembled to form the package of the type that includes a finger-operable pump and a flexible, collapsible bag containing the fluid product.

BACKGROUND OF THE INVENTION AND TECHNICAL PROBLEMS POSED BY THE PRIOR ART

Manufacturers of various fluid products have found that in some cases it is desirable to provide such products to a user in a package that readily accommodates dispensing of the product and yet protects the product from oxidation or other external contaminants during storage. It may also be desirable to provide such a product in a package that can be operated in any orientation to dispense the product.

A type of package that has been employed to accommodate these requirements includes a flexible, collapsible bag filled with the product under vacuum and attached to a finger-operable pump. The bag is disposed in a protective, but vented, housing which admits atmospheric pressure air into the housing so as to surround the exterior of the bag. The pump has an actuator projecting from one end of the housing where the pump can be operated by the user pressing down on the pump actuator.

Various designs for such collapsible bag packages are disclosed in the patent literature. While such designs may function generally satisfactorily, it would be desirable to provide an improved design for a package that could be more readily manufactured.

In particular, it would be advantageous to provide an improved design which could incorporate a conventional finger-operable pump. Such an improved design should also preferably facilitate the filling of the collapsible bag with the fluid product, attachment of the pump, and assembly of the other package components with a minimum number of manufacturing steps or special manufacturing operations.

In addition, it would be beneficial to provide such an improved dispensing package design that does not require an excessive number of components, that can be assembled relatively rapidly at low cost and without requiring excessively small manufacturing tolerances and assembly tolerances.

It would also be advantageous if various portions of the package components could be relatively easily modified so as to provide various external configurations which may be desired for utilitarian or aesthetic purposes.

The present invention provides an improved set of components for assembly as a dispensing package which can accommodate designs having the above-discussed benefits and features.

SUMMARY OF THE INVENTION

In accordance with the present invention, a dispensing package can be readily assembled from a set of components which accommodate the filling of the package with a fluid product. The product filling is preferably effected under vacuum. In the preferred embodiment, this is facilitated by arranging the components in two subassemblies. A first subassembly can be filled with the fluid product under vacuum, and then the second subassembly can be mounted to the first subassembly to form a complete package.

Three components can be connected together to form the first subassembly. One of the components is a collapsible bag for containing the fluid product. The bag comprises a flexible material having an open end defined by a peripheral portion of the material.

The second component of the first subassembly is a support which is attached to the bag. The support has an engaging structure received in the bag open end. The engaging structure of the support is sealingly secured to the bag material. The support defines a passage communicating with the interior of the bag.

The third component of the first subassembly is an enclosure or hollow body which can receive the bag and be attached to the support—preferably by a snap-fit engagement. In the preferred embodiment, the enclosure or hollow body is substantially rigid over most of its length and has a bottom end which can serve as a base for supporting the package in a generally upright orientation. The base preferably includes one or more vent holes for admitting ambient atmosphere into the interior of the body around the exterior of the bag.

The second subassembly is assembled from two main components and preferably includes one or two additional components. The first component is a retention member which can be attached to the support of the first subassembly, preferably by a snap-fit engagement. The retention member defines (1) an opening which can be located adjacent the support passage, and (2) at least one clamping surface around the opening.

A second component of the second subassembly is a finger-operable pump which can be mounted between the support and the retention member clamping surface. When properly mounted, the finger-operable pump extends within the passage of the support and within the opening of the retention member. The pump has an inlet for communicating with the interior of the collapsible bag, and the pump has an outlet for projecting beyond the retention member opening.

The second subassembly preferably includes a third component which is a separate gasket designed to insure a leak-tight seal between the pump and the support on which the pump is mounted and retained by the retention member.

Further, the second subassembly may optionally include a fourth component in the form of a cover or cap which is adapted to be mounted over the upwardly projecting, outlet end of the pump and which is intended to be removed by the user when the user desires to dispense fluid product from the package.

Typically, the first subassembly is assembled by sealingly securing the collapsible bag to the support and by attaching the enclosure or body to the support. Thereafter, the bag can be filled with fluid product in a vacuum-assisted filling process through the support passage.

Subsequently, the second subassembly pump and retention member can be mounted on the first subassembly so that the retention member is attached to the support. This is also accomplished under vacuum, and preferably the above-described gasket is disposed on the pump prior to mounting the pump and retention member in place on the support.

If the package is to also include a cap, then the cap may be initially attached to the retention member over the pump prior to mounting the second subassembly components together on the first subassembly.

According to one aspect of the present invention, means are provided for attaching the support to the hollow body around the bag, and such means facilitate manufacture of the components and facilitate subsequent assembly of the components in a relatively high-speed process. Specifically, the support includes at least one outwardly projecting rib. The hollow body includes at least one inwardly extending ledge. Either the support or the body, or both, are resiliently deflectable, at least in the region of the rib and/or ledge, so as to accommodate relative movement of the rib and ledge into a confronting relationship and establish a snap-fit engagement.

According to another aspect of the invention, means are provided for attaching the support to the retention member in a way that facilitates manufacture of the components and facilitates high-speed assembly. In particular, either the support or the retention member defines a bead, and the other of the support and retention member defines a groove for receiving the bead in mating relationship. Either the support or the retention member, or both, are resiliently deflectable, at least in the region of the bead or groove, so as to accommodate relative movement of the bead and groove into the mating relationship establishing a snap-fit engagement.

According to yet another aspect of the invention, means are provided for sealingly securing the collapsible bag to the support. In particular, in a preferred embodiment, the flexible bag material is a heat-sealable thermoplastic material. The support is molded from a heat-sealable thermoplastic material. The engaging structure of the support is heat-sealed to the bag. In the preferred arrangement, the engaging structure of the support includes (1) a first set of three, laterally extending, spaced-apart, parallel nerves or flanges, and (2) a second set of three, oppositely extending, spaced-apart, parallel nerves or flanges. The bag material is heat-sealed to the peripheral edges of the flanges.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same, FIG. 1 shows a cover or cap spaced above, and off of, the package to reveal the actuating button of the finger-operable pump;

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the components of this invention are described in an upright operating position, and terms such as upper, lower, horizontal, etc., are used with reference to this position. It will be understood, however, that the components of this invention may be manufactured, stored, transported, used, and sold in an orientation other than the position described.

Figures illustrating the components show some mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

Figure 1:
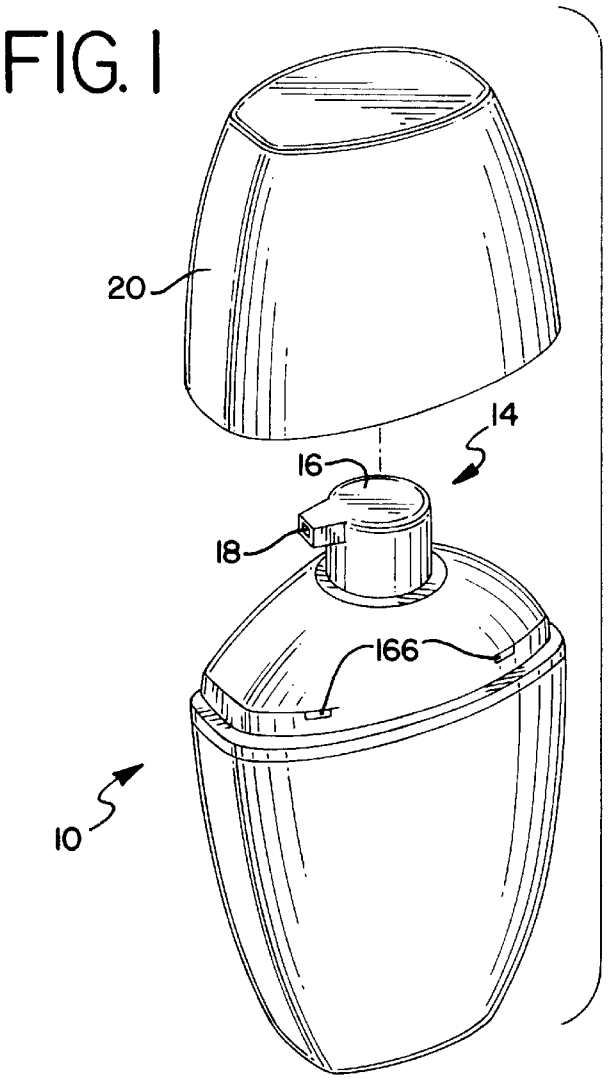
FIG. 1 is a perspective view of a preferred embodiment of a completed dispensing package assembled from the set of components according to one form of the present invention.

A dispensing package 10 is designated generally by the reference numeral 10 in FIG. 1. The package 10 is adapted to dispense a fluid product, typically a liquid, cream, paste, or the like. Such products may include personal care products such as shampoos, lotions, and the like. Such products may also include household cleaners, industrial preparations, and other substances.

The package 10 includes a container assembly which includes a projecting, finger-operable pump 14. The pump 14 may be a suitable conventional type having a pump chamber in which is disposed a pressurizing piston that can be actuated by pressing down on an external actuator button or plunger 16 to dispense a quantity of the fluid product from a dispensing orifice 18. An optional cover or cap 20 may be releasably mounted over the pump 14 (FIGS. 1 and 3).

The package 10 includes a collapsible bag 24 for containing the fluid product. The bag 24 comprises a flexible material. The material may be a thermoplastic material, preferably one which is heat-sealable, such as a film of polyvinylchloride, polypropylene, or the like. The bag 24 may be conveniently fabricated from two of webs or sheets of such material which are heat-sealed around three edges, as at 26 in FIG. 3, to define a bag having a major closed portion with an open end.

Figure 3:
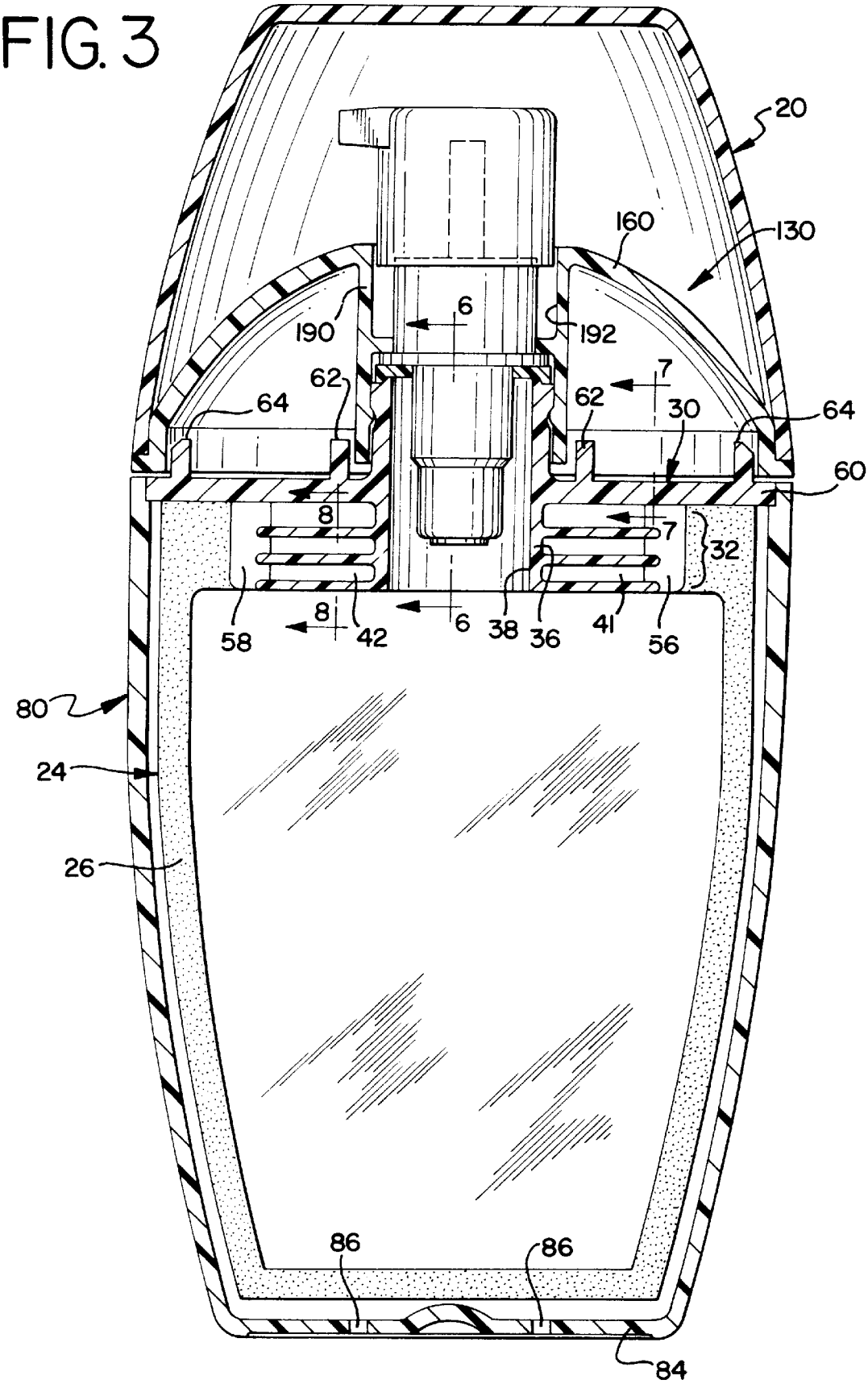
FIG. 3 is an enlarged, cross-sectional view of the package shown in FIG. 1 with the cap in place.

The open end of the bag 24 is sealingly secured to a support 30 (FIG. 3). The support 30 includes an engaging structure 32 (FIG. 3) which is received in the open end of the bag 24. The engaging structure 32 includes a downwardly projecting, hollow structure 36 defining a generally cylindrical bore 38 which communicates with the interior of the collapsible bag 24.

Figure 5:
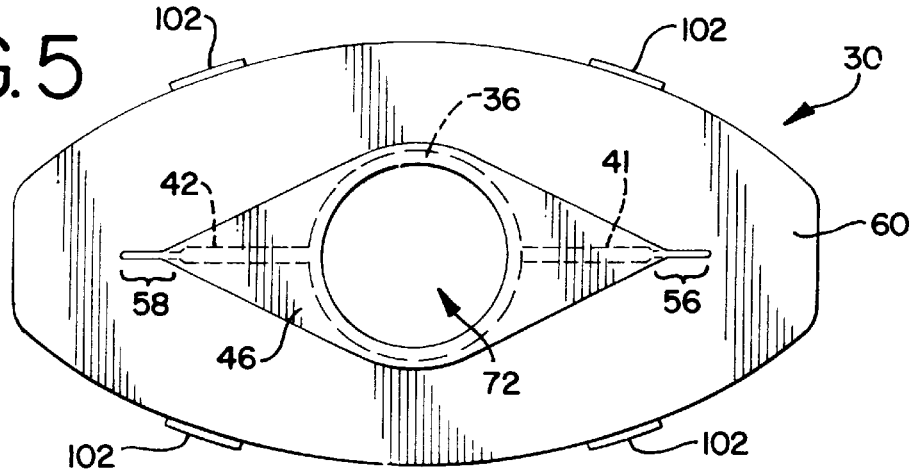
FIG. 5 is a bottom plan view of the support taken along the plane 5—5 in FIG. 2.

As shown in FIG. 3, the engaging structure 32 also includes two, coplanar walls 41 and 42 which extend radially outwardly form the hollow structure 36. As shown in FIG. 5, in the preferred embodiment, the wall 41 includes a reduced thickness, distal end portion 56. Similarly, the wall 42 has a reduced thickness, distal end portion 58.

A first set of three, spaced-apart, parallel nerves, ridges, or flanges 46 extend laterally outwardly on one side from the walls 41 and 42 and from the hollow structure 36.

Figure 8:
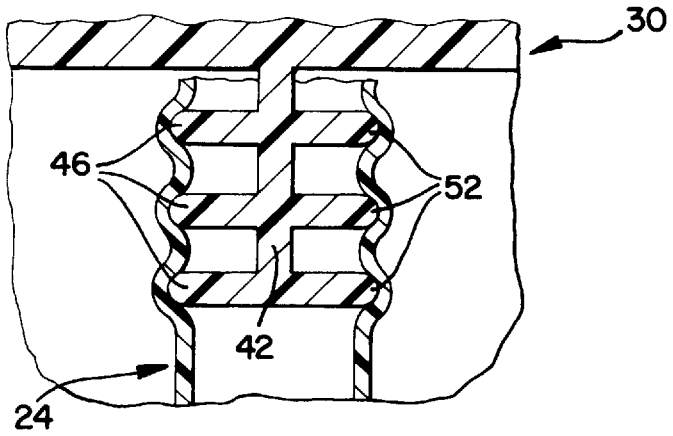
FIG. 8 is an enlarged cross-sectional view taken generally along the plane 8—8 in FIG. 3.

As illustrated in FIG. 8, a second set of three, spaced-apart, parallel flanges 52 extend laterally in the opposite direction from the other side of the walls 41 and 42 and from the hollow structure 36.

Preferably, the flanges become narrower as they extend further from the bore 38. That is, the width of the flanges decreases with increasing distance from the bore 38. As shown in FIG. 5, the bottom of the engaging structure 32 has a configuration which is somewhat like the front elevational view of an open, human eye wherein the bore 38 may be thought of as the pupil and the surrounding structure may be thought of as the white part of the eye.

Figure 6:
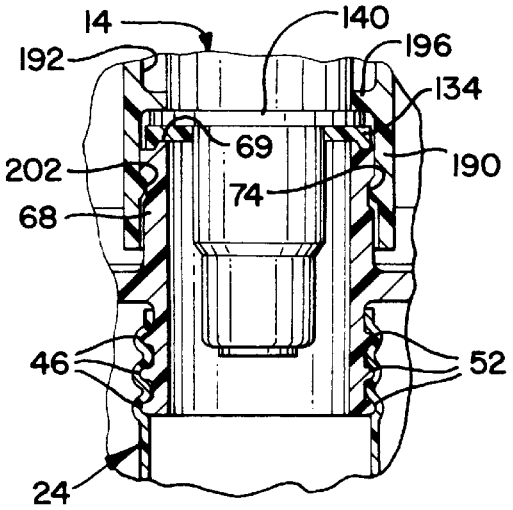
FIG. 6 is a fragmentary, cross-sectional view taken generally along the plane 6—6 in FIG. 3.
Figure 7:
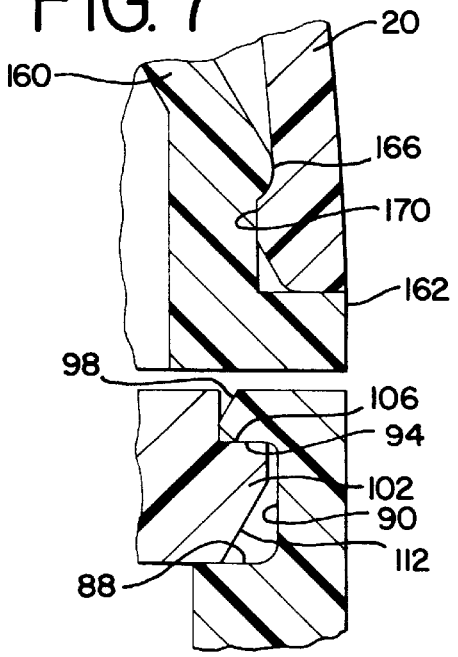
FIG. 7 is an enlarged, fragmentary, cross-sectional view taken generally along the plane 7—7 in FIG. 3.

As shown in FIGS. 6 and 7, the collapsible bag 24 is preferably heat-sealed or otherwise sealingly secured to the elongate, peripheral edges of the engaging structure flanges 46 and 52. Additionally, the collapsible bag 24 is heat-sealed to the reduced thickness distal end portions 56 and 58 of the walls 41 and 42, respectively. Thus, the open end of the bag 24 is sealingly secured around its periphery to the support engaging structure 32, but communication with the interior of the bag 24 is established through the bore 38 in the hollow structure 36.

The support 30 includes a deck 60 above, and parallel to, the flanges 46 and 52. The deck 60 extends along, and is connected to, the central walls 41 and 42, and to the thinner end portions 56 and 58.

Figure 2:
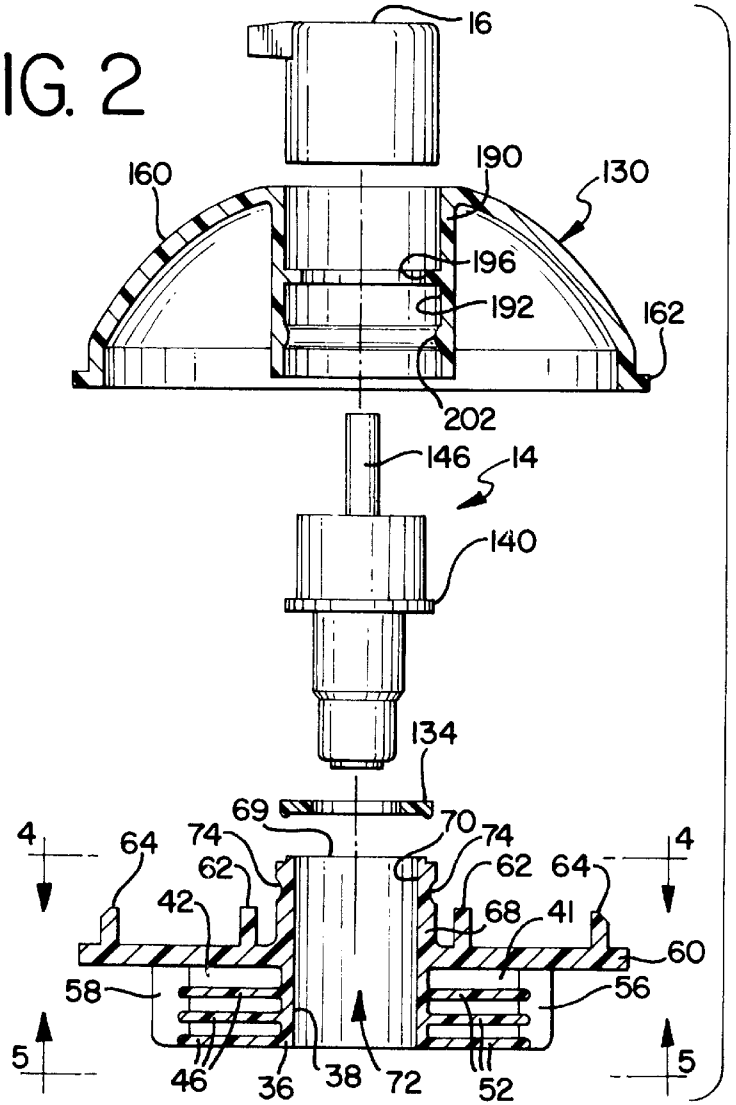
FIG. 2 is an enlarged, exploded, cross-sectional view of some of the components of the package.

Projecting upwardly from the deck 60 are a pair of rigidifying ribs 62 and a pair of shorter rigidifying ribs 64. Also projecting upwardly from the deck 60 is an annular wall 68 which has an upper end 69 (FIG. 2). The exterior of the surface of the annular wall 68 defines an outwardly open, annular groove 74.

Figure 4:
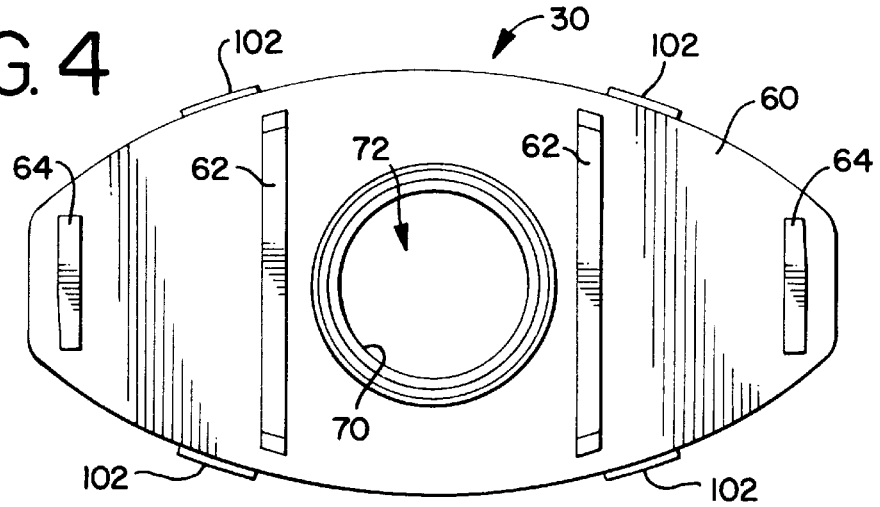
FIG. 4 is a top plan view of the support taken along the plane 4—4 of FIG. 2.

The annular wall 68 defines a bore 70 that extends from, and that is co-axial with, the bore 38 in the lower, hollow structure 36. The bore 38 and bore 70 together define a passage 72 (FIGS. 2, 4, and 5) through the support 30 which communicates with the interior of the bag 24. The passage 72 is large enough to receive the lower end of the pump 14.

The support deck 60 includes a means or structure for connecting the support 30 to an enclosure or hollow body 80 which surrounds and protects the collapsible bag 24. The hollow body 80 has an open upper end for receiving the support deck 60 and has a closed bottom end defining a generally flat base 84 for supporting the package in the generally upright orientation. The base 84 preferably includes one or more vent holes 86 for admitting ambient atmosphere into the interior of the body around the exterior of the bag 24.

Figure 9:
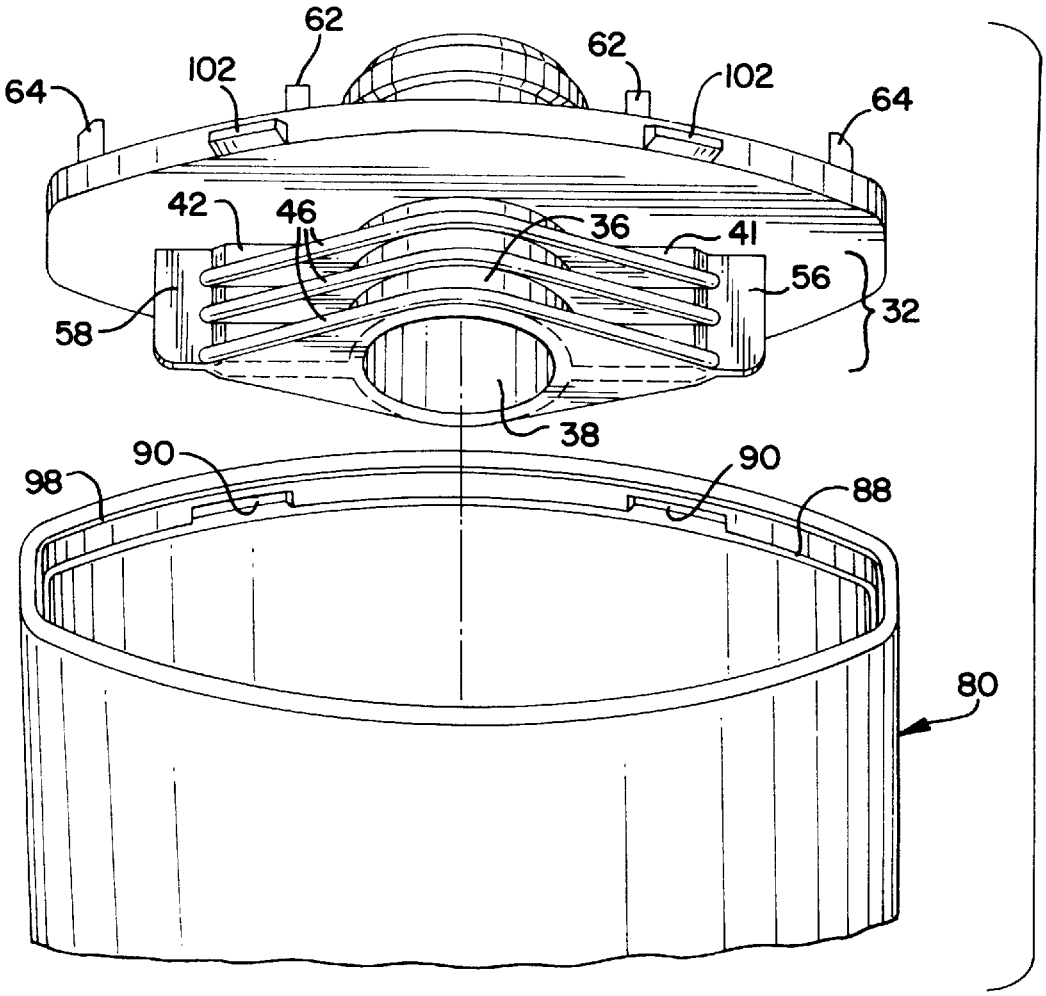
FIG. 9 is an exploded, fragmentary, perspective view of the body and bag support.

At the upper, open end of the body 80, the body 80 defines an interior, peripheral shoulder 88 (FIG. 9). The body 80 also defines four, spaced-apart recesses 90 adjacent the ledge 88. The bottom of each recess 90 is defined by the shoulder 88. The top of each recess 90 is defined by an overhanging ledge 94 (FIG. 7). The upper edge of the body 80 above each ledge 94 is angled or chamfered to define a camming surface 98 (FIG. 7).

The support 30 has four engaging members or ribs 102 for each being received in one of the hollow body recesses 90. Each rib 102 projects laterally from the side of the support deck 60. Each rib 102 includes an upwardly facing shoulder 106 and an inwardly angled camming surface 112 (FIG. 7).

Either the support 30 or the body 80, or both, are resiliently deflectable, at least in the region of the deck ribs 102 and/or in the region of the body ledges 94, so as to accommodate relative movement of the deck ribs 102 and the upper body ledges 94 into a confronting relationship so as to establish a snap-fit engagement. This is facilitated by the body camming surfaces 98 which initially engage the deck rib camming surfaces 112. When sufficiently large, opposed, axial forces are applied to the support 30 and body 80, there is temporary deflection or deformation of one or both of the components in the radial direction so that the deck ribs 102 can be moved past the inner ends of the body upper ledges 94. The deck ribs 102 become lodged between the body upper ledges 94 and the body inner shoulder 88 as shown in FIG. 7 to establish the snap-fit engagement.

After the collapsible bag 24 is sealingly secured to the support 30 and after the support 30 is attached to the hollow body 80 as described above, the resulting assembly may be characterized as a lower subassembly or first subassembly. This subassembly may be provided to a fluid product manufacturer for filling the collapsible bag 24 with a fluid product. Subsequently, the additional package components, comprising an upper subassembly or second subassembly as described below, are installed on the filled, first subassembly.

The second subassembly or upper subassembly for being mounted to the lower subassembly comprises at least two components. One of the components of the upper or second subassembly is the pump 14, and another component is a retention member 130 (FIG. 2). The actuator button 16 may be regarded as part of the pump 14. Additional components are also preferably included in the upper subassembly, and such additional components may include a gasket 134 (FIG. 2) and the cap or cover 20 (FIGS. 2 and 3). The pump 14 is initially mounted within the retention member 130, along with the gasket 134 if the gasket is employed.

The pump 14 has a radially extending mounting flange 140 (FIGS. 2 and 3) for being positioned on or over the upper end 69 of the annular wall 68 of the support 30. Preferably, in order to ensure a leak-tight seal, the gasket 134 is disposed between the pump flange 140 and the upper end 69 of the support 30. However, depending upon the materials employed in the construction of the pump 14 and/or support 30, the gasket 134 could be omitted. Alternatively, the gasket 134 may be provided as an integral or unitary part of either the pump flange 140 or the upper end 69 of the support 30.

The pump 14 may be any suitable non-venting pump of any appropriate conventional or special design. Typically, a conventional, non-venting pump, such as the pump 14 illustrated in the figures, has an interior chamber (not visible) which has a check valve at the lower end and in which is disposed a pressurizing piston (not visible). The pressurizing piston is arranged to cooperate with a hollow stem 146 which extends out through the top of the body of the pump 14 and which is received within the pump actuator button 16. The stem 146 and the piston within the pump body can move downwardly together in the pump chamber, but the hollow stem 146 can also move for some distance separately relative to the piston so as to establish communication through the hollow stem 146 between the pump chamber and the actuator button 16. One or more springs (not visible in the figures) act against the piston and/or stem 146 inside the pump body to bias the piston, stem 146, and actuator button 16 upwardly to an elevated rest position when finger pressure is released. When the actuator button 16 is pressed, product is dispensed from the pump 14.

One conventional pump that may be employed is the pump designated VP36 and sold by Valois S. A., 50 Avenue de L'Europe, 78160 Marly le roi, France. Such a pump is described in the brochure entitled "Valois Cosmetic" as published by Valois S. A. bearing a printing date of "03/93." The description of the VP36 pump in the brochure is incorporated herein by reference thereto to the extent that the description is not inconsistent with the present disclosures. Other non-venting pumps that may be employed are those sold by Valois S. A. under the designation VP39 and VP89. It will be appreciated, however, that the detailed design and operation of the internal components of such pumps, which may be employed for the pump 14 described herein, form no part of the present invention.

The retention member 130 includes a convex shroud 160 providing a pleasing, external configuration. The bottom of the shroud 160 has a laterally projecting flange 162. At four locations around the shroud 160 above the flange 162, there are small, outwardly projecting protuberances 166 (FIGS. 1 and 7). Each of the protuberances 166 is adapted to establish a snap-fit engagement with a radially inwardly extending protuberance or bead 170 at the bottom of the cap or cover 20. The cap or cover 20 and/or the lower portion of the retention member shroud 160 are resiliently deflectable so as to accommodate relative movement between the cap 20 and shroud 160 as the cap 20 is installed on the package. The cap and/or shroud components deflect sufficiently to permit the cap bead 170 to be located below, and adjacent, the protuberances 166 of the retention member shroud 160. This confronting relationship establishes the snap-fit engagement.

Projecting downwardly from the shroud 160 in the retention member 130 is an annular sleeve 190 (FIG. 2). The sleeve 190 defines an opening, bore, or passage 192 for accommodating the annular wall 68 of the support 30 and for accommodating the upwardly projecting portion of the pump 14 (FIG. 3).

An annular flange 196 extends radially inwardly from the retention member annular sleeve 190 for engaging the upper surface of the pump flange 140 (FIG. 6). The sleeve 190 also includes an inwardly extending bead 202 for being received in the annular groove 74 defined in the support annular wall 68. Either the support annular wall 68 or the retention member sleeve 190, or both, are resiliently deflectable, at least in the region of the bead 202 and/or groove 74, so as to accommodate relative movement of the bead 202 and groove 74 into a mating relationship establishing a snap-fit engagement.

Typically, the pump 14 is initially disposed in the retention member 130, along with the gasket 134 if employed. If desired, the cap 20 can also be initially mounted with a snap-fit engagement to the retention member 130 over the pump 14. This upper subassembly is then ready to be mounted to the support 30 of the lower subassembly. When the two subassemblies are properly mounted together as shown in FIGS. 3 and 6, the pump flange 140 is clamped between the retention member flange 196 and the upper end 69 of the support annular wall 68. The gasket 134 is preferably employed between the pump flange 140 and support wall upper end 69 to insure a leak-tight seal.

Prior to mounting the two subassemblies together, the lower subassembly is filled with a fluid product. This can be conveniently done pursuant to a conventional or special filling process which is typically performed under vacuum. Preferably, vacuum (i.e., a reduced pressure) is created by a suitable vacuum system around the enclosure or body 80. The air within the body 80 is evacuated through the vent holes 86 in the base of the body. Then the fluid product is discharged from a filling machine into the bag 24 through the central passage 72 in the support 30. Next, with vacuum still enveloping the components, the upper subassembly (comprising the pump 14, retention member 130, gasket 134 if employed, and cap 20 if employed) is moved into position on the lower subassembly support 30 so as to establish the snap-fit engagement between the support 30 and retention member 130. The particular process and detailed operation of filling the bag 24 and mounting the upper subassembly on the lower subassembly form no part of the present invention.

The set of components provided according to the present invention can be readily manufactured from. thermoplastic materials at relatively low cost. Thus, packages made from the set of components may be regarded as disposable packages or throw-away packages.

The set of components can be readily assembled to provide a package which can be easily used. Except for the removable cap 20, the components are not readily disassembled, and the completed package protects the fluid product from oxidation or other external contaminants.

It will be readily apparent from the foregoing detailed description of the invention and from the illustrations thereof that numerous variations and modifications may be effected without departing from the true spirit and scope of the novel concepts or principles of this invention.

What is claimed is:

1. A set of components for assembly as a dispensing package for containing and dispensing a fluid product, said set comprising:

a collapsible bag for containing said fluid product and comprising a flexible material having an open end defined by a peripheral portion of said material;

a support attached to said bag, said support having an engaging structure received in said bag open end and sealingly secured to said bag material, said support defining a passage communicating with the interior of said bag;

a hollow body which can receive said bag and be attached to said support;

a retention member which can be attached to said support, said retention member defining (1) an opening which can be located adjacent said support passage, and (2) at least one clamping surface around said opening;

a finger-operable pump which can be mounted between said support and said retention member clamping surface for extending within said support passage and said retention member opening, said pump having an inlet for communicating with the interior of said bag and having an outlet for projecting beyond said retention member opening; and said support including at least one outwardly projecting rib, said body including at least one inwardly extending ledge, and at least one of said support and said body being resiliently deflectable to accommodate relative movement of said rib and ledge into confronting relationship establishing a snap-fit engagement.

2. The set of components in accordance with claim 1 in which said support includes a plurality of said ribs and said body includes a plurality of said ledges; and each said ledge confronts one of said ribs in a snap-fit engagement.

3. The set of components in accordance with claim 1 in which said rib has an angled camming surface.

4. The set of components in accordance with claim 1 in which said body defines an angled camming surface above said ledge.

5. The set of components in accordance with claim 1 in which said body defines a recess below said ledge for receiving said rib.

6. A set of components for assembly as a dispensing package for containing and dispensing a fluid product, said set comprising:

a collapsible bag for containing said fluid product and comprising a flexible material having an open end defined by a peripheral portion of said material;

a support attached to said bag, said support having an engaging structure received in said bag open end and sealingly secured to said bag material, said support defining a passage communicating with the interior of said bag;

a hollow body which can receive said bag and be attached to said support;

a retention member which can be attached to said support, said retention member defining (1) an opening which can be located adjacent said support passage, and (2) at least one clamping surface around said opening;

a finger-operable pump which can be mounted between said support and said retention member clamping surface for extending within said support passage and said retention member opening, said pump having an inlet for communicating with the interior of said bag and having an outlet for projecting beyond said retention member opening; and one of said support and said retention member defining a bead, the other of said support and retention member defining a groove for receiving said bead in mating relationship, and at least one of said support and said retention member being resiliently deflectable to accommodate relative movement of said bead and groove into said mating relationship establishing a snap-fit engagement.

7. The set of components in accordance with claim 6 in which said support includes an annular wall which defines said passage and which terminates in an upper end, said annular wall having an exterior surface defining said groove as an outwardly open, annular groove;

said retention member has an annular sleeve for receiving said annular wall of said support; and said bead is an inwardly extending bead on said sleeve.

8. A set of components for assembly as a dispensing package for containing and dispensing a fluid product, said set comprising:

a collapsible bag for containing said fluid product and comprising a flexible material having an open end defined by a peripheral portion of said material;

a support attached to said bag, said support having an engaging structure received in said bag open end and sealingly secured to said bag material, said support defining a passage communicating with the interior of said bag;

a hollow body which can receive said bag and be attached to said support;

a retention member which can be attached to said support, said retention member defining (1) an opening which can be located adjacent said support passage, and (2) at least one clamping surface around said opening;

a finger-operable pump which can be mounted between said support and said retention member clamping surface for extending within said support passage and said retention member opening, said pump having an inlet for communicating with the interior of said bag and having an outlet for projecting beyond said retention member opening; and said bag material being a heat-sealable thermoplastic material, said support being molded from a heat-sealable thermoplastic material, and said engaging structure of said support being heat-sealed to said bag.

9. The set of components in accordance with claim 8 in which said engaging structure of said support includes a first set of three, spaced-apart, parallel flanges and a second set of three, oppositely extending, spaced-apart, parallel flanges; and said bag material is heat-sealed to said flanges.

10. The set of components in accordance with claim 9 in which said support engaging structure includes a downwardly projecting hollow structure having a cylindrical bore defining a portion of said support passage;

two, coplanar walls extend radially outwardly from said hollow structure; and each said flange of said first and second sets of flanges extends from said hollow structure and from said walls in a direction generally perpendicular to said walls.

11. The set of components in accordance with claim 10 in which said width of said flanges decreases with increasing distance from said bore.

* * * * *